US010483648B2

(12) United States Patent
Robinson et al.

(10) Patent No.: US 10,483,648 B2
(45) Date of Patent: Nov. 19, 2019

(54) CAVITY-BACKED ANNULAR SLOT ANTENNA ARRAY

(71) Applicant: The MITRE Corporation, McLean, VA (US)

(72) Inventors: Eric D. Robinson, Cambridge, MA (US); Ian T. McMichael, Stow, MA (US)

(73) Assignee: The MITRE Corporation, McLean, VA (US)

( * ) Notice: Subject to any disclaimer, the term of this patent is extended or adjusted under 35 U.S.C. 154(b) by 128 days.

(21) Appl. No.: 15/937,395

(22) Filed: Mar. 27, 2018

(65) Prior Publication Data

US 2019/0305435 A1 Oct. 3, 2019

(51) Int. Cl.

| | |
|---|---|
| ***H01Q 13/10*** | (2006.01) |
| ***H01Q 13/18*** | (2006.01) |
| ***H01Q 1/38*** | (2006.01) |
| ***H01Q 21/00*** | (2006.01) |

(52) U.S. Cl.

CPC ..... *H01Q 13/18* (2013.01); *H01Q 1/38* (2013.01); *H01Q 13/103* (2013.01); *H01Q 21/0062* (2013.01)

(58) Field of Classification Search

CPC ..... H01Q 13/18; H01Q 1/38; H01Q 13/103; H01Q 21/0062

See application file for complete search history.

(56) References Cited

U.S. PATENT DOCUMENTS

| | | | | |
|---|---|---|---|---|
| 8,629,812 | B2 * | 1/2014 | Jaffri | H01Q 13/18 343/767 |
| 2015/0084814 | A1 | 3/2015 | Rojanski et al. | |
| 2015/0226846 | A1 | 8/2015 | Tedeschi et al. | |
| 2017/0142605 | A1 | 5/2017 | Cheng et al. | |

FOREIGN PATENT DOCUMENTS

| | | |
|---|---|---|
| CN | 105024172 | 11/2015 |
| CN | 206003962 | 3/2017 |

* cited by examiner

*Primary Examiner* — Dieu Hien T Duong
(74) *Attorney, Agent, or Firm* — Morrison & Foerster LLP

(57) ABSTRACT

Cavity backed slot antenna arrays for conformal antenna applications are provided. A cavity backed slot antenna array may include an aperture, first and second feed structures, and a backing cavity configured to support the aperture and the first and second feed structures. The aperture may have a dielectric layer and a metal layer disposed on the dielectric layer. The metal layer may have first and second annular regions. The first annular region may have a first slot region and the second annular region may have a second slot region, where the second slot region may partially overlap the first slot region. The metal layer may further include first and second radiating elements configured to radiate energy. Each of the first and second feed structures may include a central portion and a plurality of fin structures arranged radially around the central portion.

20 Claims, 4 Drawing Sheets

CAVITY-BACKED ANNULAR SLOT ANTENNA ARRAY

STATEMENT REGARDING FEDERALLY SPONSORED RESEARCH OR DEVELOPMENT

This invention was made with Government support under U.S. Government contract FA8702-17-C-0001 awarded by the U.S. Department of the Air Force. The Government has certain rights in this invention.

FIELD OF THE INVENTION

This invention relates generally to wide-band antennas and, more specifically, to cavity-backed overlapping annular slot antennas.

BACKGROUND OF THE INVENTION

A cavity-backed annular slot (CBAS) antenna typically includes a metal surface having a radiating element and an annular slot through which electromagnetic energy is radiated. The metal surface is backed by a resonant cavity that encloses an antenna feed structure for providing excitation to the radiating element. These CBAS antennas provide an omnidirectional azimuth gain pattern, which enables efficient reception and transmission between transmitters and receivers that are positioned in the same plane as the antenna.

The structure and gain pattern of the CBAS antenna enables it to be used as a conformal antenna. That is, CBAS antennas are often used in antenna applications that require the antenna to be conformal to an external surface so that the antenna or any protruding elements of the antenna do not interfere with the desired characteristics of the external surface. For example, a CBAS antenna may be integrated into a flat or curved external surface of a vehicle (e.g., aircraft, watercraft, spacecraft, or land vehicle) to prevent or reduce aerodynamic drag or any other adverse effects to the aerodynamics of the vehicle surface.

SUMMARY OF THE INVENTION

In conformal antenna applications, it is desirable to arrange cavity-backed annular slot (CBAS) antennas in an array with a spacing between inter-antenna elements (e.g., spacing between the centers of adjacent antenna slots and/or feed structures) equal to or less than a half wavelength to optimize antenna array space and performance. However, traditional antenna arrays of CBAS antennas are limited by the geometry of the antennas. In order to achieve optimal wideband performance, the traditional CBAS antennas have a minimum diameter. For example, optimal radiation in the traditional antenna arrays of CBAS antennas occurs when the diameter of the annular slots ranges from about 0.55 wavelength to about 1.0 wavelength, depending on the feed structure, matching structure, and annular slot outer/inner diameter ratio. This diameter is large enough to prevent the traditional CBAS antennas from being spaced equal to or less than half a wavelength apart in an array configuration, which results in larger antenna arrays of CBAS antennas and undesirable radiation in the form of grating lobes when beamforming. Thus, traditional CBAS antenna arrays experience a tradeoff between bandwidth and inter-antenna element spacing, with hard lower limits on spacing.

Accordingly, there is a need to overcome the tradeoff between bandwidth and inter-antenna element spacing in CBAS antenna array applications to optimize antenna array space and performance. The present disclosure may address this need by providing compact and wideband CBAS antenna arrays with minimal gain pattern variation and an inter-antenna element spacing less than a half wavelength without sacrificing bandwidth or simplicity of the antenna design. The CBAS antenna arrays provided in the present disclosure may achieve a bandwidth ranging from about 20% to about 35% of a center frequency of a matched operating frequency band of the antenna arrays. In some embodiments, these compact and wideband CBAS antenna arrays may exhibit omnidirectional gain and minimal azimuthal gain pattern ripple at the horizon, and may be suitable for omnidirectional antenna applications such as, for example, beamforming, nulling, and direction finding. The low profile, recessed design of the compact and wideband CBAS antenna arrays in the present disclosure may allow for them to be flush-mounted to a metal surface such as a vehicle.

In some embodiments, the compact and wideband CBAS antenna array provided in the present disclosure may include an array of distinct slot apertures and a set of magnetic current modes in a common backing cavity. Each of the slot apertures may include a plurality of overlapping annular slots and a plurality of radiating elements that may be backed by a common cavity. In some embodiments, the plurality of radiating elements may include radial slots that may be positioned orthogonally to the annular slots to minimize undesired modes (e.g., magnetic current modes) in the antennas. In some embodiments, the common backing cavity may enclose a plurality of feed structures that may be designed as fin-type structures. Each fin-type feed structure of the plurality of fin-type feed structures may be radially symmetrical along its central axis or its axis of symmetry and may include fin structures that may be arranged in a radially symmetric manner around the central axis. In some embodiments, the fin-type feed structures may be configured to reduce or substantially eliminate unwanted inter-antenna element coupling between these feed structures. The inter-antenna element coupling may be defined as a measure of the amount radiation energy lost to adjacent antennas instead of being radiated effectively from the antenna array.

Unlike the fin-type feed structures provided in the present disclosure, the traditional feed structures of the traditional CBAS antenna arrays cannot be placed in a common backing cavity as the traditional feed structures are not configured to prevent inter-antenna element coupling when the traditional feed structures are within a common backing cavity. Typically, each of the traditional feed structures, which are non-fin-type, need to be placed in a separate backing cavity to isolate these feed structures from each other and prevent inter-antenna element coupling. As such, the traditional CBAS antenna array space optimization is further limited by the traditional feed structure geometry.

Thus, in some embodiments, the overlapping of the annular slots in an array configuration and the placement of the fin-type feed structures in a common backing cavity may overcome the spacing and performance challenges in the traditional CBAS antenna array applications discussed above.

In some embodiments, a cavity backed slot antenna array includes an aperture having a dielectric layer and a metal layer disposed on the dielectric layer, where the metal layer includes a first annular region having a first slot region and a second annular region having a second slot region, where the second annular region partially overlaps the first annular region. The metal layer further includes first and second radiating elements configured to radiate energy. The cavity backed slot antenna array further includes a first feed structure configured to excite the first radiating element and a second feed structure configured to excite the second radiating element, where each of the first and second feed structures include a central portion and a plurality of fin structures arranged radially around the central portion. The cavity backed slot antenna array further includes a backing cavity configured to support the aperture and the first and second feed structures.

In some embodiments of the cavity backed slot antenna array, the first and second slot regions partially overlap each other.

In some embodiments of the cavity backed slot antenna array, the aperture further includes third and fourth annular regions arranged to partially overlap each other and the first and second annular regions, where the third annular region includes a third slot region and the fourth annular region includes a fourth slot region and where the first, second, third, and fourth slot regions partially overlap with each other.

In some embodiments of the cavity backed slot antenna array, a lateral distance between axes of symmetry of the first and second feed structures is equal to or less than half a wavelength at a center frequency of an operating frequency band of the cavity backed slot antenna array.

In some embodiments of the cavity backed slot antenna array, a lateral distance between centers of the first and second slot regions is equal to or less than half a wavelength at a center frequency of an operating frequency band of the cavity backed slot antenna array.

In some embodiments of the cavity backed slot antenna array, the first slot region includes an outer radius and an inner radius, where a ratio of the outer radius to the inner radius ranges from about 1 to about 2.

In some embodiments of the cavity backed slot antenna array, the first radiating element is electrically coupled to the first feed structure, where the second radiating element is electrically coupled to the second feed structure.

In some embodiments of the cavity backed slot antenna array, the first radiating element includes a first radial slot and the second radiating element includes a second radial slot, where the first and second radial slots are configured to direct current flow in a direction parallel to the first and second radial slots and to prevent current flow in a direction perpendicular to the first and second radial slots.

In some embodiments of the cavity backed slot antenna array, each fin structure of the plurality of fin structures includes a tapered profile.

In some embodiments of the cavity backed slot antenna array, each fin structure of the plurality of fin structures includes a hemispherical or triangular profile.

In some embodiments of the cavity backed slot antenna array, the first and second feed structures are positioned within the backing cavity such that there is a minimum lateral distance between walls of the backing cavity and the first and second feed structures, where the minimum lateral distance ranges from about 0.1 wavelengths to about 0.5 wavelengths at a center frequency of an operating frequency band of the cavity backed slot antenna array.

In some embodiments of the cavity backed slot antenna array, the plurality of fin structures are configured to prevent coupling between the first and second feed structures.

In some embodiments of the cavity backed slot antenna array, a first gap is present between the first radiating element and the first feed structure and a second is present between the second radiating element and the second feed structure, where the first and second gaps prevent a short between a ground plane and the first and second radiating elements.

In some embodiments of the cavity backed slot antenna array, the first and second feed structures are radially symmetrical about the central portion.

In some embodiments, a cavity backed slot antenna array includes an aperture having a plurality of slot regions arranged to partially overlap each other and a plurality of radiating elements configured to radiate energy; a plurality of feed structures configured to provide excitation to the plurality of radiating elements, where each feed structure of the plurality of feed structures includes a central portion and a plurality of fin structures arranged radially around the central portion; and a backing cavity configured to support the aperture and the plurality of feed structures.

In some embodiments of the cavity backed slot antenna array, a lateral distance between centers of at least two slot regions from among the plurality of slot regions is equal to or less than half a wavelength at a center frequency of an operating frequency band of the cavity backed slot antenna array.

In some embodiments of the cavity backed slot antenna array, at least one of the slot regions from among the plurality of slot regions includes an outer radius and an inner radius, where a ratio of the outer radius to the inner radius ranges from about 1 to about 2.

In some embodiments of the cavity backed slot antenna array, each radiating element of the plurality of radiating elements includes a radial slot, where the radial slots are configured to direct current flow in a direction parallel to the radial slots and to prevent current flow in a direction perpendicular to the radial slots.

In some embodiments of the cavity backed slot antenna array, each fin structure of the plurality of fin structures includes a hemispherical or triangular profile.

In some embodiments, a cavity backed slot antenna array includes an aperture having a plurality of slot regions arranged to partially overlap each other and in a rectangular or a circular array configuration and a plurality of radiating elements configured to radiate energy; a plurality of feed structures configured to provide excitation to the plurality of radiating elements, each feed structure of the plurality of feed structures comprising a central portion and a plurality of fin structures, arranged radially around the central portion comprising a hemispherical or a triangular profile; and a backing cavity configured to support the aperture and the plurality of feed structures.

BRIEF DESCRIPTION OF THE DRAWINGS

The present disclosure is described with reference to the accompanying drawings. In the drawings, like reference numbers generally indicate identical or similar elements.

DETAILED DESCRIPTION OF EXEMPLARY EMBODIMENTS

Figure 2:
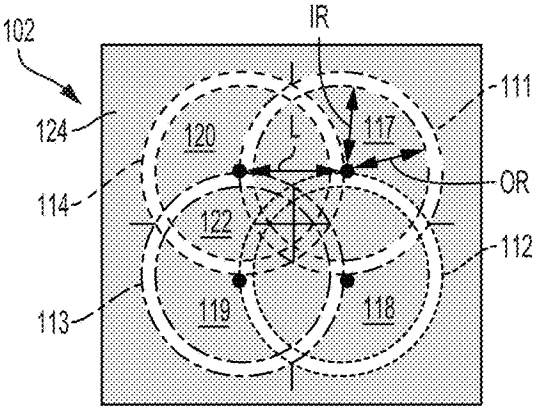
FIG. 2 illustrates a top view of an aperture of a cavity backed annular slot antenna array, according to some embodiments.

As discussed above, in CBAS antenna array applications, the optimization of antenna array space and performance are limited by the tradeoff between bandwidth and inter-antenna element spacing of the CBAS antenna arrays. The optimization of antenna array space is further limited by the geometry of the traditional feed structures in CBAS antenna arrays, as discussed above.

Disclosed herein are embodiments of compact and wideband CBAS antenna arrays having fin-type feed structures that help to overcome the limitations of the traditional CBAS antenna arrays and the traditional feed structures. The compact and wideband CBAS antenna arrays disclosed herein may have a minimal gain pattern variation and an inter-antenna element spacing less than a half wavelength. The CBAS antenna arrays provided in the present disclosure may achieve a bandwidth ranging from about 20% to about 35% of a center frequency of a matched operating frequency band of the antenna arrays. In some embodiments, these CBAS antenna arrays may exhibit omnidirectional gain and minimal azimuthal gain pattern ripple at the horizon, and may be suitable for omnidirectional antenna applications such as, for example, beamforming, nulling, and direction finding. The low profile, recessed design of these CBAS antenna arrays may allow for them to be flush-mounted to a metal surface such as a vehicle.

In some embodiments, the compact and wideband CBAS antenna array may include an aperture having a plurality of overlapping annular slots and a plurality of radiating elements having radial slots that may be positioned orthogonally to the annular slots to minimize undesired modes (e.g., magnetic current modes) in the antennas. The aperture may be backed by a common cavity that may enclose a plurality of fin-type feed structures configured to reduce or substantially eliminate unwanted inter-antenna element coupling between the fin-type feed structures. The overlapping of the annular slots in an array configuration and the placement of the fin-type feed structures in a common backing cavity may help to overcome the spacing and performance challenges in the traditional CBAS antenna array applications discussed above.

In the following description of the disclosure and embodiments, reference is made to the accompanying drawings in which are shown, by way of illustration, specific embodiments that can be practiced. It is to be understood that other embodiments and examples can be practiced, and changes can be made, without departing from the scope of the disclosure.

In addition, it is also to be understood that the singular forms "a," "an," and "the" used in the following description are intended to include the plural forms as well, unless the context clearly indicates otherwise. It is also to be understood that the term "and/or"," as used herein, refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

Reference is made herein to antennas including radiating elements of a particular size and shape. For example, certain embodiments of radiating element are described having a shape and a size compatible with operation over a particular frequency range. Those of ordinary skill in the art would recognize that other shapes of radiating elements may also be used and that the size of one or more radiating elements may be selected for operation over any frequency range (e.g., any frequency in the RF frequency range or any frequency in the range from below 20 MHz to above 50 GHz).

Reference is sometimes made herein to generation of an antenna beam having a particular shape or beam-width. Those of ordinary skill in the art would appreciate that antenna beams having other shapes may also be used and may be provided using known techniques, such as by inclusion of amplitude and phase adjustment circuits into appropriate locations in an antenna feed circuit and/or multi-antenna element network.

Standard antenna engineering practice characterizes antennas in the transmit mode. According to the well-known antenna reciprocity theorem, however, antenna characteristics in the transmit mode correspond to antenna characteristics in the receive mode. Accordingly, the below description provides certain characteristics of antennas operating in a transmit mode with the intention of characterizing the antennas equally in the receive mode.

Figure 1:
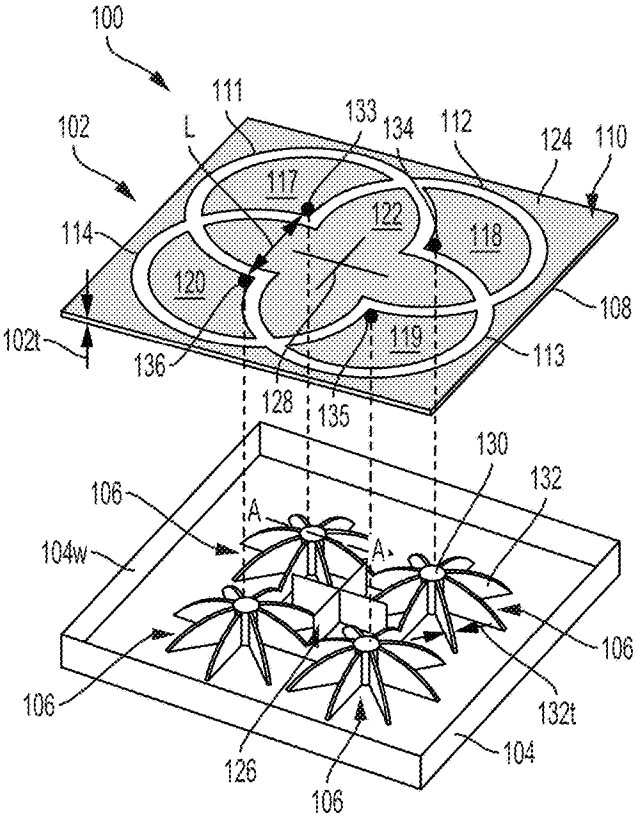
FIG. 1 illustrates an exploded view of a cavity backed annular slot antenna array, according to some embodiments.

FIG. 1 illustrates an exploded view of a cavity backed annular slot (CBAS) antenna array 100, according to some embodiments. In some embodiments, antenna array 100 may be configured to exhibit minimal inter-antenna element coupling and azimuthal gain variation at the horizon, and may be suitable for omnidirectional applications such as, for example, direction finding and beamforming. In some embodiments, antenna array 100 may be configured to be flush-mounted to a metal surface such as an external metal surface of a vehicle. In some embodiments, antenna array 100 may achieve an operating bandwidth in a range from about 20% to about 35% of a center frequency of a matched operating frequency band of antenna array 100. In some embodiments, antenna array 100 may achieve an operating bandwidth that is at least about 20%, at least about 22%, at least about 25%, or at least about 30% of a center frequency of a matched operating frequency band of antenna array 100. In some embodiments, antenna array 100 may achieve an operating bandwidth that is less than about 40%, less than about 38%, less than about 36%, or less than about 35% of a center frequency of a matched operating frequency band of antenna array 100. In some embodiments, antenna array 100 may include an aperture 102, a common backing cavity 104, and fin-type feed structures 106.

Aperture 102 may include a dielectric layer 108 and a metal layer 110 disposed on dielectric layer 108. Even though FIG. 1 shows aperture 102 as being positioned on backing cavity 104 with dielectric layer 108 facing feed structures 106, in some embodiments, aperture 102 may be placed on backing cavity 104 with metal layer 110 facing feed structures 106. Dielectric layer 108 may serve as a protective layer for aperture 102 when aperture 102 may be placed on backing cavity 104 with metal layer 110 facing feed structures 106.

In some embodiments, aperture 102 may have a thickness 102*t* that may allow aperture 102 to be flexible and/or bendable for conformal antenna applications. In some embodiments, aperture thickness 102*t* may be selected based on the amount of energy to be received by and/or transmitted from antenna array 100. In some embodiments, aperture thickness 102*t* may range from about 1% of a wavelength to about 2% of a wavelength, where the wavelength may correspond to the center frequency or the highest frequency of the matched operating frequency band of antenna array 100. In some embodiments, aperture thickness 102*t* may range from about 0.1% of the wavelength to about 1% of the wavelength. In some embodiments, aperture thickness 102*t* may be at least about 0.1%, at least about 0.3%, at least about 0.5%, at least about 0.7%, at least about 0.9%, or at least about 1% of a wavelength, where the wavelength may correspond to the center frequency or the highest frequency of the matched operating frequency band of antenna array 100. In some embodiments, aperture thickness 102*t* may be less than about 2%, less than about 1.8%, less than about 1.6%, less than about 1.4%, less than about 1.2%, or less than about 1% of a wavelength, where the wavelength may correspond to the center frequency or the highest frequency of the matched operating frequency band of antenna array 100.

In some embodiments, metal layer 110 may include a conductive metal such as, for example, aluminum, copper, or stainless steel. In some embodiments, dielectric layer 108 may be a printed circuit board (PCB) and metal layer 108 may be the metal layer of the PCB. In some embodiments, dielectric layer 108 may include a dielectric material having a dielectric constant ranging from about 2 to about 4. In some embodiments, dielectric layer 108 may include a dielectric material having a dielectric constant that is at least about 1, at least about 1.5, or at least about 2. In some embodiments, dielectric layer 108 may include a dielectric material having a dielectric constant that is less than about 5, less than about 4.5, or less than about 4. In some embodiments, dielectric layer 108 may include a dielectric material having a dielectric constant of about 2.33. In some embodiments, dielectric layer 108 having a dielectric material with a dielectric constant higher than 4 may reduce the bandwidth of antenna array 100. Based on the disclosure herein, it will be recognized that other materials for metal layer 110 and dielectric layer 108 are within the scope and spirit of this disclosure.

In some alternate embodiments, dielectric layer 108 may be absent and metal layer 110 may be disposed on a dielectric material such as, for example a low dielectric constant foam that fills backing cavity 104. The dielectric material may fill backing cavity 104 in such a way that except for feed ports 133 through 136 (represented by black dots on aperture 102 in FIGS. 1-2) being connected to their corresponding feed structures 106, as shown by vertical dashed lines in FIG. 1, other metal regions of metal 110 are isolated from feed structures 106 within backing cavity 104. In some embodiments, the dielectric material filling backing cavity 104 may have a dielectric constant ranging from about 2 to about 4. In some embodiments, the dielectric material filling backing cavity 104 may have a dielectric constant that is at least about 1, at least about 1.5, or at least about 2. In some embodiments, the dielectric material filling backing cavity 104 may have a dielectric constant that is less than about 5, less than about 4.5, or less than about 4.

Aperture 102 may further include annular regions 111 through 114 in metal layer 110. Annular regions 111 through 114 are shown in further details in FIG. 2 that illustrates a top view of aperture 102. In some embodiments, annular regions 111 through 114 may be similar to or different from each other with respect to lateral dimensions such as inner diameter and/or outer diameter. In some embodiments, annular regions 111 through 114 may be arranged in a rectangular array configuration and may overlap at least partially with each other as shown in FIGS. 1-2. Each of annular regions 111 through 114 may include a slot region, which is shown in FIGS. 1-2 as a white region within each of annular regions 111 through 114. In some embodiments, the slot region is the region in each of annular regions 111 through 114 where the metal has been removed from metal layer 110, and as such, portions of underlying dielectric layer 108 may be visible through the slot regions. In some embodiments, the slot region in each of annular regions 111 through 114 may constitute an arc portion (shown in FIGS. 1-2) or a complete portion of its corresponding annular region.

The outer and inner radii of the slot regions may be similar to the respective outer and inner radii (e.g., OR and IR as shown in FIG. 2) of annular regions 111 through 114. In some embodiments, the outer and inner radii of the slot regions may be selected based on the desired radiation bandwidth of antenna array 100. In some embodiments, each of the slot regions may have a ratio of outer radius to inner radius ranging from about 1 to about 2 or from about 1.15 to about 1.3. In some embodiments, each of the slot regions may have a ratio of outer radius to inner radius of about 1.2. In some embodiments, each of the slot regions may have a ratio of outer radius to inner radius that is at least about 0.5, at least about 0.8, at least about 1, or at least about 1.2. In some embodiments, each of the slot regions may have a ratio of outer radius to inner radius that is less than about 3, less than about 2.5, less than about 2, or less than about 1.5. In some embodiments, one or more of the slot regions may have a ratio of outer radius to inner radius ranging from about 1 to about 2 or from about 1.15 to about 1.3. In some embodiments, one or more of the slot regions may have a ratio of outer radius to inner radius that is at least about 0.5, at least about 0.8, at least about 1, or at least about 1.2. In some embodiments, one or more of the slot regions may have a ratio of outer radius to inner radius that is less than about 3, less than about 2.5, less than about 2, or less than about 1.5. As the outer and inner radii of the slot regions may be similar to the respective outer and inner radii of the annular regions 111 through 114, each of annular regions 111 through 114 may have a ratio of outer radius to inner radius similar to its corresponding slot region.

In some embodiments, the slot regions may be formed to overlap with each other as shown in FIGS. 1-2. The overlapping configuration of the slot regions may allow the slot regions and/or feed ports 133 through 136 to be spaced apart from each other by a lateral distance equal to or less than half a wavelength, where the wavelength may correspond to the center frequency or the highest frequency of the matched operating frequency band of antenna array 100. In some embodiments, the lateral distance between two slot regions may be a lateral distance between the centers (represented as black dots within annular regions 111 through 114 in FIGS. 1-2) of the two slot regions. For example, as shown in FIGS. 1-2, slot regions of annular regions 111 and 114 and/or feed ports 133 and 136 may be spaced apart by a lateral distance L that may be equal to or less than half a wavelength. In some embodiments, lateral distance L may be about 0.4 wavelengths or 0.5 wavelengths at the center frequency of operation of antenna array 100.

Figure 3:
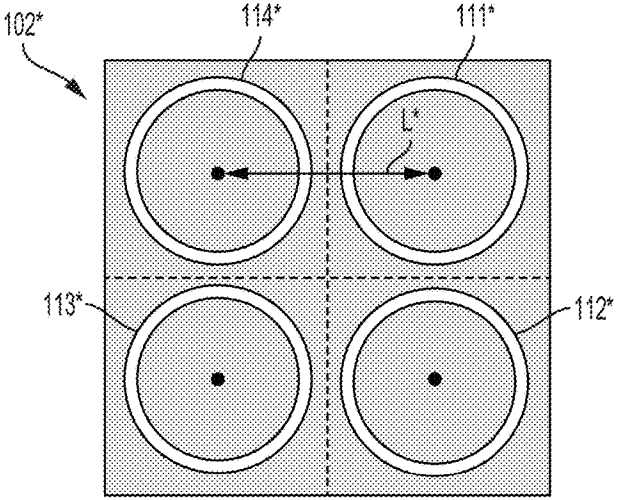
FIG. 3 illustrates top views of apertures of a traditional cavity backed annular slot antenna array.

As discussed above, it is desirable to have an antenna array with a spacing between inter-antenna elements (e.g., spacing between the centers of adjacent antenna slots and/or feed structures) equal to or less than a half wavelength to optimize antenna array space and performance. The overlapping configuration of the slot regions of antenna array 100 may help to achieve this desired inter-antenna element spacing, which is not observed in traditional cavity backed annular slot antenna arrays. For example, FIG. 3 shows a top view of an aperture 102* of a traditional CBAS antenna array having four slot regions 111* through 114* that are arranged in a non-overlapping array configuration. The slot regions 111* through 114* are typically spaced apart from each other by a lateral distance (e.g., lateral distance L*) of about 1.0 wavelength for optimal wideband performance of the traditional CBAS antenna arrays as the traditional CBAS antenna arrays experience a tradeoff between bandwidth and inter-antenna element spacing (discussed above).

Referring back to FIGS. 1-2, metal regions 117 through 120 of metal layer 110 may be configured to be radiating elements of aperture 102. Metal regions 117 through 120 are referred herein as radiating elements 117 through 120. Radiating elements 117 through 120 may each include a distinct phase center and may be configured to transmit and/or receive electromagnetic energy during operation of antenna array 100. As shown in FIGS. 1-2, radiating elements 117 through 120 may be formed within respective annular regions 111 through 114. Each of radiating elements 117 through 120 may be electrically isolated from each other radiating element by portions of one or more of the slot regions of aperture 102. In some embodiments, each of radiating elements 117 through 120 may be configured to receive excitation from corresponding one of feed structures 106 through feed ports 133 through 136. In FIGS. 1-2, the black dots represent the feed ports 133 through 136 and in FIG. 1, the vertical dashed lines represent the correspondence and electrical connections between the feed ports 133 through 136 and feed structures 106.

Aperture 102 may further include a metal region 122 that may be a part of metal layer 110. In some embodiments, metal region 122 may be configured to be a non-radiating region 122 and may not receive excitation signals from a feed structure. In such embodiments of antenna array 100, non-radiating metal region 122 may be physically connected to metal cross-plates 126 in backing cavity 104 and may be configured to be shorted to the ground. Metal cross-plates 126 may be aligned with plus-sign alignment marker 128 of aperture 102, as shown in FIG. 1, and may provide mechanical support to aperture 102 when placed on backing cavity 104.

In some embodiments, metal region 122 may be configured to be a radiating element 122 and may be provided excitation from a feed structure similar to feed structures 106. Radiating element 122 may be configured to transmit and/or receive electromagnetic energy during operation of antenna array 100. In such embodiments of antenna array 100, a feed structure for radiating element 122 may be present in place of metal cross-plates 126. The feed structure for radiating element 122 may be similar to feed structures 106.

In some embodiments, aperture 102 may include metal region 124 that may be a part of metal layer 110 and may be configured to be a non-radiating region. In some embodiments, metal region 124 may be removed from aperture 102. It should be noted that even though four annular regions 111 through 114 having slot regions arranged in a 2×2 array configuration are shown in FIGS. 1-2, a person skilled in the art would understand that an aperture of antenna array 100 may include two or more annular regions having slot regions and may be arranged in any array configuration, according to various embodiments.

Backing cavity 104 may be configured to support aperture 102 and feed structures 106. In some embodiments, backing cavity 102 may include metal cross plates 126 that may be configured to connect and align aperture 102 at plus sign alignment marker 128 and to physically support aperture 102 within backing cavity 104. Metal cross plates 126 may be further configured to short metal region 122 to the ground and to shape the magnetic current modes within backing cavity 104. Metal cross plates 126 may have dimensions ranging from about 0.1 wavelengths to about 0.5 wavelengths, where the wavelength may correspond to the center frequency or the highest frequency of the matched operating frequency band of antenna array 100. In some embodiments, metal cross plates 126 may have dimensions that are at least about 0.05 wavelengths, at least about 0.07 wavelengths, at least about 0.1 wavelengths, or at least about 0.12 wavelengths. In some embodiments, metal cross plates 126 may have dimensions that are less than about 1.0 wavelength, less than about 0.8 wavelengths, or less than about 0.6 wavelengths.

Backing cavity 104 may include a conductive metal, such as, for example, copper, aluminum, or stainless steel. In some embodiments, backing cavity 104 may have a geometric shape such as, but not limited to, rectangular, cylindrical, trapezoidal, spherical, elliptical, or polygonal. In some walls 104*w* of backing cavity 104 may have a geometric shape such as, but not limited to, rectangular, cylindrical or polygonal. The horizontal dimensions of backing cavity 104 may be determined based on an area of the combined footprints of the slot regions of aperture 102. That is, the horizontal dimensions of backing cavity 104 may be selected such that the slot regions of aperture 102 are within the perimeter of backing cavity 104.

Additionally, in some embodiments, the horizontal dimensions of backing cavity 104 may be selected based on a minimum distance requirement between walls 104*w* of backing cavity and feed structures 106. The minimum distance requirement is to avoid limiting the desired magnetic current modes within backing cavity 104. Placing feed structures 106 at a distance from walls 104*w* of backing cavity 104 that is less than the minimum distance requirement may negatively affect the impedance matching of antenna array 100 and, consequently, may reduce the operating bandwidth of antenna array 100. On the other hand, placing feed structures 106 at a distance from walls 104*w* of backing cavity 104 that is greater than the minimum distance requirement not only increases the size of antenna array 100, but may also cause distortions in gain patterns of antenna array 100. In some embodiments, placing feed structures 106 at a distance from walls 104*w* that is greater or less than the minimum distance requirement by a certain percentage value of the minimum distance requirement may not significantly degrade the performance of antenna array. This percentage value may range from about 15% to about 35%. In some embodiments, the percentage value may be at least about 15%, at least about 17%, or at least about 20%. In some embodiments, the percentage value may be less than about 35%, less than about 30%, or less than about 25%.

In some embodiments, the horizontal dimensions of backing cavity 104 in first and second directions may be at least about 0.5 wavelengths, at least about 1.0 wavelength, at least about 1.5 wavelengths or at least about 2.0 wavelengths, where the wavelength may correspond to the center frequency or the highest frequency of the matched operating frequency band of antenna array 100. In some embodiments, the horizontal dimensions of backing cavity 104 in first and second directions may be less than about 3.0 wavelengths, less than about 2.5 wavelengths, or less than about 2.0 wavelengths, where the wavelength may correspond to the center frequency or the highest frequency of the matched operating frequency band of antenna array 100. In some embodiments, the horizontal dimensions of backing cavity 104 in first and second directions may range from about 1.0 wavelength to about 2.0 wavelengths and the minimum distance requirement may range from about 0.1 wavelengths to about 0.5 wavelengths, where the wavelength may correspond to the center frequency or the highest frequency of the matched operating frequency band of antenna array 100. In some embodiments, the horizontal dimension of backing cavity 104 in each of first and second directions may be about 1.2 wavelengths and the minimum distance requirement may be about 0.3 wavelengths.

A vertical dimension (e.g., depth) of backing cavity 104 is a geometric parameter that may be selected based on accommodating the magnetic current modes for antenna array 100 to radiate over the desired bandwidth. Magnetic current modes within backing cavity 104 may be visualized as continuous loops of magnetic field vectors surrounding feed structures 106 within backing cavity 104. The size of each magnetic loop is directly correlated to the wavelength of the electric fields radiated by antenna array 100. The size and shape of the magnetic current loops are partially determined by the radius and taper of feed structures 106. In some embodiments, the vertical dimension of backing cavity 104 may be at least about 0.05 wavelengths, at least about 0.1 wavelengths, at least about 0.15 wavelengths, or at least about 0.2 wavelengths, where the wavelength may correspond to the center frequency or the highest frequency of the matched operating frequency band of antenna array 100. In some embodiments, the vertical dimension of backing cavity 104 may be less than about 0.3 wavelengths, less than about 0.25 wavelengths, or less than about 0.2 wavelengths, where the wavelength may correspond to the center frequency or the highest frequency of the matched operating frequency band of antenna array 100. In some embodiments, the vertical dimension of backing cavity 104 may range from about 0.10 wavelengths to about 0.20 wavelengths, where the wavelength may correspond to the center frequency or the highest frequency of the matched operating frequency band of antenna array 100. In some embodiments, the vertical dimension of backing cavity 104 may be about 0.13 wavelengths Fin-type feed structures 106 may be placed in common backing cavity 104 and at a distance from walls 104*w* that is substantially equal to the minimum distance requirement discussed above. In some embodiments, a lateral distance between axes of symmetry of any two feed structures 106 may be equal to or less than half a wavelength. In some embodiments, the lateral distance may be about 0.4 wavelengths or 0.5 wavelengths at the center frequency of operation of antenna array 100. In some embodiments, the lateral distance may be at least about 0.2 wavelengths, at least about 0.3 wavelengths, at least about 0.4 wavelengths, or at least about 0.5 wavelengths at the center frequency of operation of antenna array 100. In some embodiments, the lateral distance may be less than about 1.0 wavelength, less than about 0.8 wavelengths, less than about 0.6 wavelengths, or less than about 0.4 wavelengths at the center frequency of operation of antenna array 100.

Each of feed structures 106 may include a central portion 130 and a plurality of fin structures 132. Central portion 130 may have a hollow cylindrical structure that will be discussed in further details with reference to FIG. 5. In some embodiments, fin structures 132 may be connected to central portion 132 and may be radially arranged around central portion 130. Each of feed structures 106 may be radially symmetrical about its central axis or axis of symmetry represented by the vertical dashed lines shown in FIG. 1.

In some embodiments, fin structures 132 may be configured to reduce or prevent undesirable magnetic current modes and inter-antenna element coupling between feed structures 106 and to provide a uniform antenna gain pattern. As discussed above, this unwanted coupling occurs when traditional feed structures, which do not have fin structures such as fin structures 132, are placed in a common cavity such as backing cavity 104 without any electrical isolation between the traditional feed structures. Fin structures 132 may provide a larger surface area to currents in the circumferential direction and not the radial direction in feed structures 106 than that provided by the structural shape of traditional feed structures. With the help of fin structures 132, the magnetic field and current flow patterns on feed structures 106 may be shaped as desired, and consequently, the undesirable magnetic current modes may be suppressed and the unwanted inter-antenna element coupling may be prevented between feed structures 106 within backing cavity 104.

Fin structures 132 may be formed by removing wedges of an initial hemispherical shaped feed structure (not shown). The removal of wedges to form fin structures 132 may be performed in order to shape the flow of currents on the surfaces of feed structures 106 for efficient performance of antenna array 100. Radial currents towards or away from feed structures 106 are desirable, but circular currents around the circumference of feed structures 106 are undesirable as they produce nulls in the antenna gain pattern of antenna array 100. Radial currents are desirable because they correspond to vertical electric fields, which in turn correspond to the desired orientation of the magnetic current modes. In some embodiments, the desirable current flow pattern around feed structures 106 may be determined based on Characteristic Mode (CM) analysis. The possible current modes, and their effect on the inter-antenna element coupling and the far-field antenna pattern, may be determined and visualized using the CM analysis to isolate currents corresponding to distinct, orthogonal radiation eigenmodes. These eigenmodes may be determined via a Method-of-Moments solution in a full-wave electromagnetic solver. Thus, this analysis may enable to determine the shape of the current flow for efficient performance of antenna array 100. Based on this analysis, the sections of the initial hemispherical feed structure that may have the undesirable current flow may be removed to form the structure of fin-type feed structures 106, and consequently, may achieve uniform gain pattern of antenna array 100 and reduced coupling between feed structures 106 in common backing cavity 104.

Even though of feed structures 106 are shown in FIG. 1 to have eight fin structures 132, feed structures 106 may have two or more fin structures 132 depending on the desired current flow pattern of antenna array 100. In some embodiments, the radius and the angle of tapering of fin structures 132 may depend on the desired size and shape of the magnetic field in antenna array 100. In some embodiments, each of fin structures 132 may have a thickness 132*t* that is at least about 0.5 mm, at least about 1 mm, at least about 3 mm, or at least about 5 mm. In some embodiments, each of fin structures 132 may have a thickness 132*t* that is less than about 6 mm, less than about 5 mm, less than about 4 mm, or less than about 3 mm. In some embodiments, each of fin structures 132 may have a thickness 132*t* ranging from about 1 mm to about 5 mm thick. In some embodiments, each of fin structures 132 may have a thickness 132*t* of about 2.5 mm. In some embodiments, each of fin structures 132 may have a thickness 132*t* that is at least about 0.01 wavelengths, at least about 0.03 wavelengths, or at least about 0.05 wavelengths, where the wavelength may correspond to the center frequency or the highest frequency of the matched operating frequency band of antenna array 100. In some embodiments, each of fin structures 132 may have a thickness 132*t* that is less than about 0.1 wavelengths, less than about 0.07 wavelengths, or less than about 0.05 wavelengths, where the wavelength may correspond to the center frequency or the highest frequency of the matched operating frequency band of antenna array 100. In some embodiments, each of fin structures 132 may have a thickness 132*t* of about 0.01 wavelengths, where the wavelength may correspond to the center frequency or the highest frequency of the matched operating frequency band of antenna array 100. Even though fin structures 132 are shown to have a hemispherical profile in FIGS. 1 and 5-6, fin structures 132 may have any tapered profile such as, for example, triangular. In some embodiments, fin structures 132 may include a conductive metal such as, for example, aluminum, copper, or stainless steel.

Figure 4:
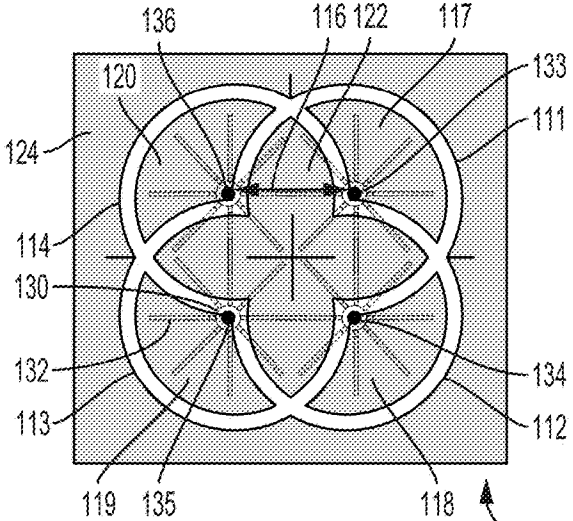
FIG. 4 illustrates top views of aperture and feed structures of a cavity backed annular slot antenna array, according to some embodiments.

Feed structures 106 may be configured to provide excitation signals through feed ports 133 through 136 of aperture 102 to radiating elements 117 through 120. Each of feed ports 133 through 136 may align with corresponding top surfaces of central portions 130 of feed structures 106 when aperture 102 is supported by backing cavity 104 and/or metal cross plates 126. FIG. 4 illustrates this alignment of feed ports 133 through 136 with their corresponding central portions 130 of feed structures. FIG. 4 shows a top view of aperture 102 and the underlying feed structures, which are shown in dashed lines as the underlying feed structures may not be visible through aperture 102.

Figure 5:
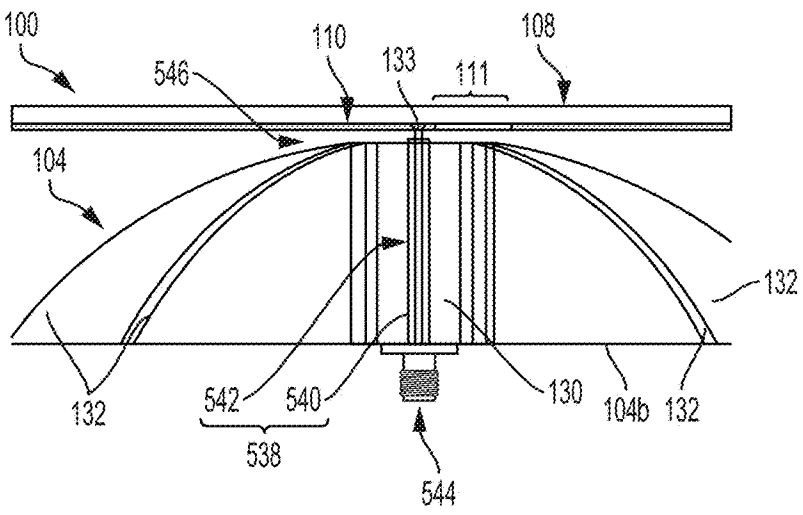
FIG. 5 illustrates a cross-sectional view of a cavity backed annular slot antenna array, according to some embodiments.

Each of feed structures 106 may further include a feed line 538 (not shown in FIG. 1; shown in FIG. 5) that may be configured to provide excitation signals to corresponding radiating elements 117 through 120. The arrangement of feed lines 538 with respect to feed structures 106 and aperture 102 will be discussed with reference to FIG. 5. FIG. 5 shows a cross-sectional view of antenna array 100 along line A-A which runs through one of feed structures 106 that is connected to feed port 133. FIG. 5 shows a cross-sectional view of antenna array when aperture 102 is supported on backing cavity 102 with the side of metal layer 110 facing feed structures 106. Antenna array 100 may have similar cross-sectional views of the other feed structures 106.

As shown in FIG. 5, feed line 538 may be connected to bottom surface 104*b* of backing cavity 104 through a connector 544 (e.g., a coaxial connector). Feed line 138 may include a coaxial cable having an outer conductor 540 and an inner conductor 542, according to some embodiments. In some embodiments, outer conductor 540 may be a hollow metal conductor that may be physically and electrically connected to feed structure 106. Outer conductor 540 may run through the hollow region of central portion 130 of feed structure 106 as shown in FIG. 5. Outer conductor 540 may be electrically isolated from aperture 102. In some embodiments, inner conductor 542 runs through the hollow region of outer conductor 540 and may be physically and electrically connected to feed port 133. In some embodiments, the connection between inner conductor 542 and feed port 133 may be a soldered connection.

In some embodiments, as shown in FIG. 5, a gap 546 may be present between aperture 102 and feed structure 106. Gap 546 between feed structure 106 and aperture 102 may be spanned by inner conductor 542 of feed line 538. This gap 546 may be help to prevent a short between the ground plane and radiating elements 117 through 120. The size of gap 546 may influence the type of impedance in antenna array 100. Tuning this gap size may require adjustments of other parameters to re-tune antenna array 100. In some embodiments, gap 546 may have a vertical dimension ranging from about 0.5 mm to about 2 mm. In some embodiments, the vertical dimension of gap 546 may be about 1 mm.

In some embodiments, in a first step of fabricating antenna array 100, the entirety of backing cavity 104, feed structures 106, and metal cross plates 126 may be milled out of a single piece of metal (e.g., aluminum, copper, or stainless steel). In some embodiments, the milling process may be performed using a computer numerical control (CNC) milling machine. In some embodiments, backing cavity 104, feed structures 106, and metal cross plates 126 may be milled separately and then joined together by, for example, soldering, welding, or friction fitting. In some embodiments, in a second step of fabricating antenna array 100, aperture 102 may be fabricated as a milled PCB with metal traces and then placed above backing cavity 104. The first and second steps of fabricating antenna array 100 may be performed simultaneously or in any order of operation. In some embodiments, in a third step of fabricating antenna array 100, holes may be drilled from back surface 104*b* of backing cavity 104 through feed structures 106 to connect connectors 544. In some embodiments, in a fourth step of fabricating antenna array 100, inner conductors 542 of feed lines 538 may be soldered directly to the corresponding radiating elements 117 through 120 and/or feed ports 133 through 136. In some embodiments, in a fifth step of fabricating antenna array 100, outer conductors 540 of feed lines 538 may be soldered or otherwise be electrically connected to feed structures 106. In some embodiments, in a sixth step of fabricating antenna array 100, metal cross plates 126 may be soldered or fused to aperture 102 at plus sign alignment marker 128. The third, fourth, fifth and sixth steps of fabricating antenna array 100 may be performed simultaneously or in any order of operation. In some embodiments, all or some components of antenna array 100 may be fabricated using additive manufacturing.

Figure 6:
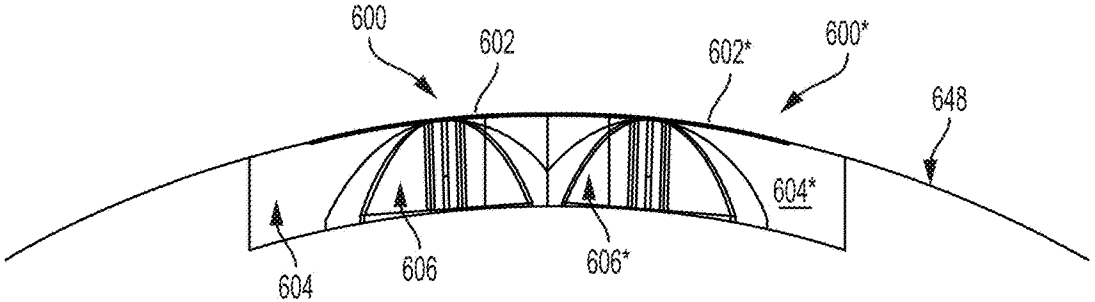
FIG. 6 illustrates cross-sectional views of cavity backed annular slot antenna arrays, according to some embodiments.

FIG. 6 illustrates a conformal antenna application of antenna arrays 600 and 600*. As shown in FIG. 6, antenna arrays 600 and 600* may be flush-mounted to an external surface 648 of a vehicle. Antenna arrays 600 and 600* may be similar in structure and function to antenna array 100 as discussed above. Antenna array 600 may include aperture 602, common backing cavity 604, and feed structures 606 and antenna array 600* may include aperture 602*, common backing cavity 604*, and feed structures 606*. Apertures 602 and 602*, backing cavities 604 and 604*, and feed structures 606 and 606* may be similar in structure and function to aperture 102, backing cavity 104, and feed structures 106, respectively. As shown in FIG. 6, antenna arrays 600 and 600* may be integrated into the vehicle body such that the antennas are conformal to the curved shape of external surface 648 and the apertures are flush with external surface 648. In some embodiments, backing cavities 600 and 600* may have metal lips around the perimeter of their cavity openings for mounting theses cavities on external surface 648 with screws or rivets (not shown). In some embodiments, screws or adhesives may be used to hold apertures 602 and 602* flush to the openings of their respective backing cavities 604 and 604*. In some embodiments, instead of using backing cavities, a recess in the vehicle body may be configured as a backing cavity such as backing cavities 604 and 604*.

Figure 7:
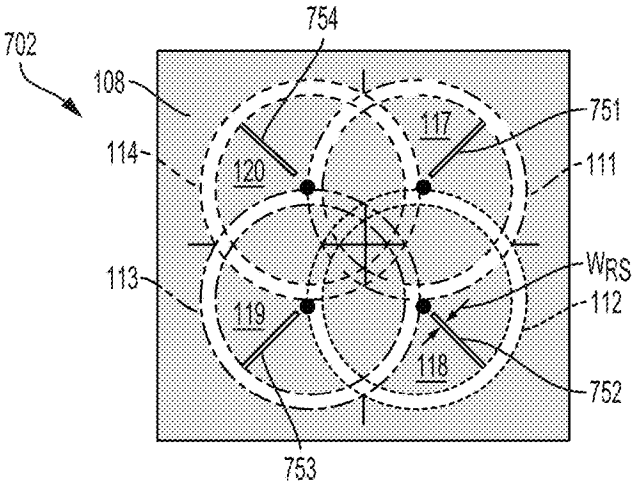
FIG. 7 illustrates a top view of an aperture of a cavity backed annular slot antenna array, according to some embodiments.

FIG. 7 illustrates a top view of an aperture 702 that may be similar in structure, composition, and function to aperture 102 unless mentioned otherwise. The discussion of elements of aperture 102 applies to elements of aperture 702 with the same annotations unless mentioned otherwise. In some embodiments, aperture 702 may be implemented as an aperture of antenna array 100 in place of aperture 102. For the sake of simplicity, backing cavity 104 and feed structures 106 are not shown in FIG. 7. In some embodiments, aperture 702 may exclude metal region 124, unlike aperture 102. Non-radiating metal region such as metal region 124 of aperture 102 surrounding annular regions 111 through 114 may be removed from aperture 702 to improve impedance matching of an antenna array (e.g., antenna array 100) to 50 ohms, and consequently, increase bandwidth of the antenna array.

In some embodiments, aperture 702 may include radial slots 751 through 754 within radiating elements 117 through 120, respectively. In some embodiments, radial slots 751 through 754 may be positioned orthogonal to the slot regions of annular regions 111 through 114. Radial slots 751 through 754 may be configured to minimize undesired current modes and shape the current flow pattern on aperture 702 and feed structures 106 such that circular currents are reduced on aperture 702 and feed structures 106 in favor of radial currents. These circular currents are undesirable because they contribute nulls to the antenna gain pattern. Thus, radial slots 751 through 754 may be configured to force these circular currents to instead flow in a desired radial direction. That is, radial slots 751 through 754 may be configured to direct current flow in a direction parallel to the radial slots and to prevent current flow in a direction perpendicular to the radial slots. This method of mode suppression using radial slots 751 through 754 may also reduce coupling between feed structures 106 and/or between adjacent antenna element ports of antenna array 100. Having radial slots 751 through 754 in aperture 702 may result in more radially symmetric current on the conductive portions of aperture 702 (e.g., radiating elements 117 through 120) compared to aperture 102, and consequently, may reduce ripple in the omnidirectional gain pattern of antenna array 100 at the horizon.

In some embodiments, the undesired current modes may be introduced in antenna array 100 in the absence of radial slots 751 through 754 in aperture 702. These undesired current modes may be a result of the overlapping configuration of the slot regions in aperture 702 and the placement of feed structures in common backing cavity 104. These undesirable current modes form magnetic current loops around multiple feed structures 106 and corresponded to undesirable, azimuthally asymmetric radiation patterns in antenna array 100. In some embodiments, Characteristic Mode (CM) analysis of antenna array 100 may be performed to determine these undesirable modes and design radial slots 751 through 754 in aperture 702 to suppress these modes. Characteristic Modes can be interpreted as the radiation eigenmodes of an antenna or scattering object.

In some embodiments, each of radial slots 751 through 754 may have a width $W_{RS}$ that is at least about 1 mm, at least about 2 mm, at least about 3 mm, or at least about 4 mm. In some embodiments, each of radial slots 751 through 754 may have a width $W_{RS}$ that is less than about 7 mm, less than about 5 mm, or less than about 4 mm. In some embodiments, each of radial slots 751 through 754 may have a width $W_{RS}$ that is at least about 0.01 wavelengths, at least about 0.03 wavelengths, or at least about 0.05 wavelengths, where the wavelength may correspond to the center frequency or the highest frequency of the matched operating frequency band of antenna array 100. In some embodiments, each of radial slots 751 through 754 may have a width $W_{RS}$ that is less than about 0.1 wavelengths, less than about 0.07 wavelengths, or less than about 0.05 wavelengths, where the wavelength may correspond to the center frequency or the highest frequency of the matched operating frequency band of antenna array 100. In some embodiments, each of radial slots 751 through 754 may have a width $W_{RS}$ ranging from about 2 mm to about 4 mm or from about 0.01 wavelengths to about 0.02 wavelengths. In some embodiments, each of radial slots 751 through 754 may have a width $W_{RS}$ of about 2.5 mm. In some embodiments, width $W_{RS}$ of each radial slot may be equal to or different from each other. In some embodiments, each of radial slots 751 through 754 may have a length ranging from about 0.1 wavelengths to about 0.3 wavelengths, where the wavelength may correspond to the center frequency or the highest frequency of the matched operating frequency band of antenna array 100. In some embodiments, each of radial slots 751 through 754 may have a length that is at least about 0.05 wavelengths, at least about 0.1 wavelengths, or at least about 0.2 wavelengths. In some embodiments, each of radial slots 751 through 754 may have a length that is less than about 0.5 wavelengths, less than about 0.3 wavelengths, or less than about 0.2 wavelengths.

Figure 9:
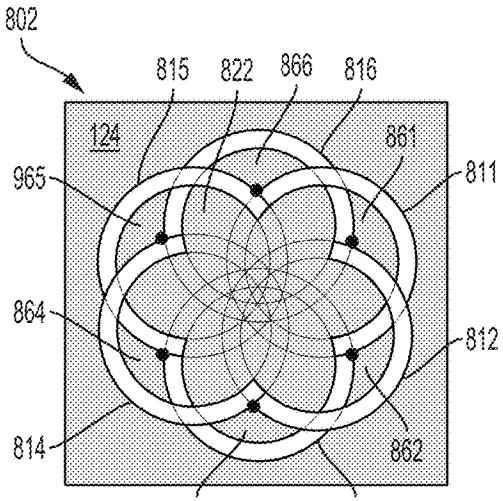
FIG. 9 illustrates a top view of an aperture of a cavity backed annular slot antenna array, according to some embodiments.
Figure 8:
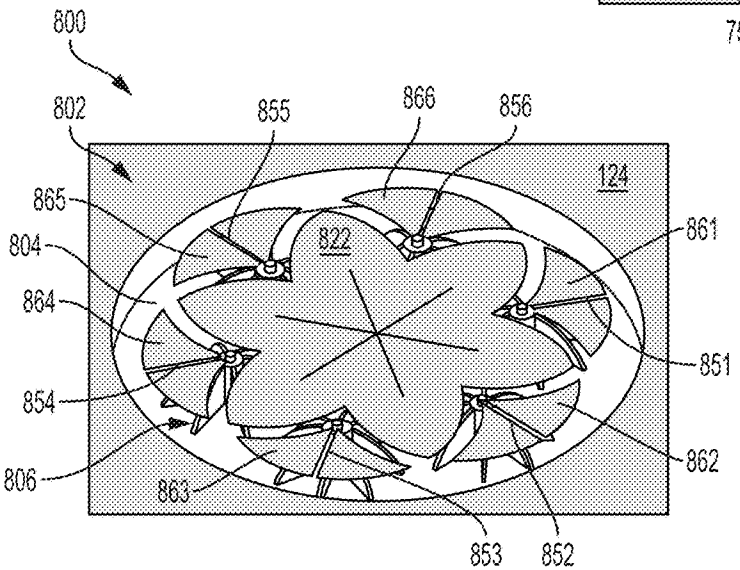
FIG. 8 illustrates an isometric view of a cavity backed annular slot antenna array, according to some embodiments.

FIG. 8-9 shows an isotrometric view of an antenna array 800 and a top view of aperture 802 of antenna array 800, respectively. FIGS. 8-9 illustrates another example embodiment of a cavity backed antenna array having overlapping slot regions in an array configuration that may be configured to achieve performance characteristics similar to that of antenna array 100. That is antenna array 800 may be configured to exhibit minimal inter-antenna element coupling and azimuthal gain variation at the horizon, and may be suitable for omnidirectional applications such as, for example, direction finding and beamforming.

Antenna array 800 may include an aperture 802, a common backing cavity 804, and feed structures 806. Backing cavity 804 and feed structures 806 may be similar to respective backing cavity 104 and feed structures 106 discussed above. As shown in FIGS. 8-9, aperture 802 may include radiating elements 861 through 866 and radial slots 851 through 856 (not shown in FIG. 9) in respective radiating elements 861 through 866. Each of radiating elements 861 through 866 may be electrically connected to respective one of feed structures 806. Aperture 802 further includes non-radiating regions 822 and 824. Radiating elements 861 through 866 and non-radiating regions 822 and 824 may be disposed on a dielectric layer such as dielectric layer 108, but the dielectric layer is not shown in FIG. 8 for the purpose of clarity. The elements of aperture 802 may be similar in structure and function to the elements of aperture 102 except aperture 802 may have six annular regions 811 through 816 arranged in an overlapping circular array configuration instead of the four annular regions of aperture 102 arranged in an overlapping rectangular array configuration.

Figure 11:
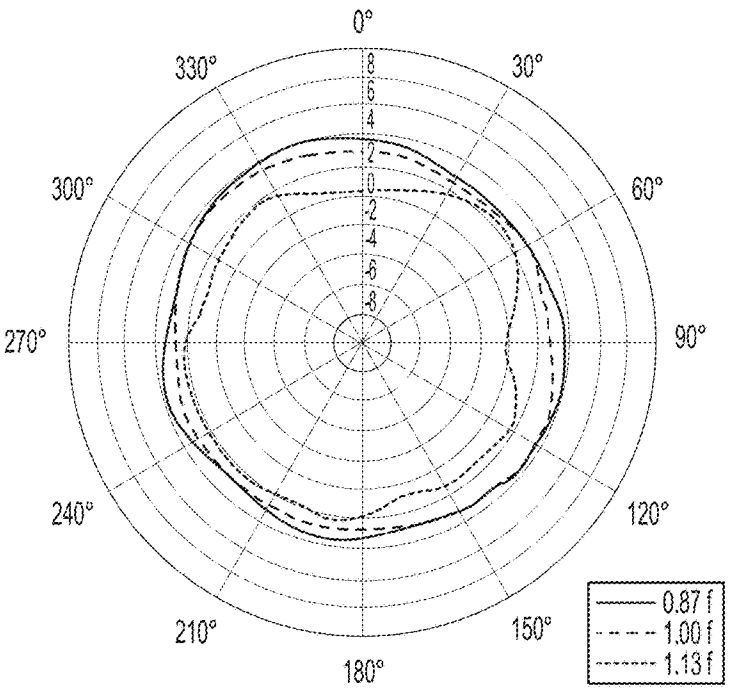
FIG. 11 is a polar chart of a simulated azimuthal gain pattern of a cavity backed annular slot antenna array, according to some embodiments.
Figure 10:
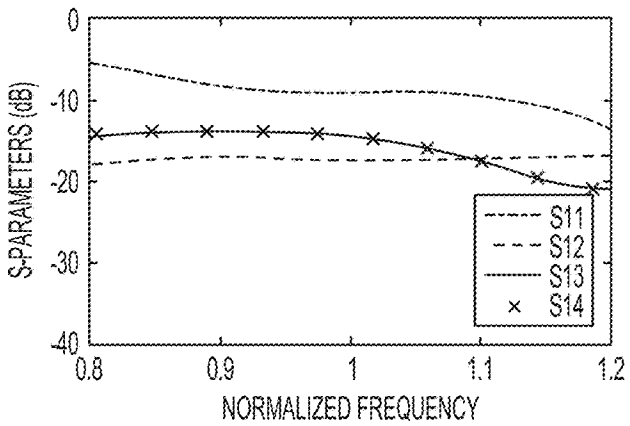
FIG. 10 is a simulated plot of scattering parameters of a cavity backed annular slot antenna array, according to some embodiments.
Figure 12:
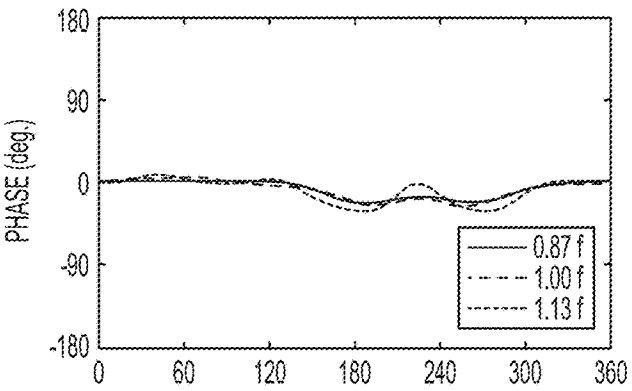
FIG. 12 is a rectangular chart of a simulated azimuthal gain pattern of a cavity backed annular slot antenna array, according to some embodiments.

FIGS. 10-12 show the simulated performance results of a modeled cavity backed annular slot antenna array similar in structure to antenna array 100 discussed above. The ratio of outer slot radius to inner slot radius is 1.2 and the lateral distance between the slot regions or feed ports is 0.4 wavelengths of the modeled antenna array when operating at the center of the matched frequency band. The backing cavity is 1.2 wavelengths in length and width, with a depth of 0.13 wavelengths. A thin dielectric layer with permittivity of 2.33 is placed above the aperture to approximate a PCB dielectric. The modeled antenna array is simulated using High Frequency Structure Simulator (HFSS) with the antenna array conformal to an infinite perfect electric conductor (PEC) ground plane. HFSS simulation is accomplished using the Finite-Element Method to calculate the electric and magnetic field propagation for an electrically excited antenna structure. Embedded element patterns are simulated by exciting a single radiating element with a 50-ohm port while the remaining three radiating elements are terminated with matched loads. The S-parameters of FIG. 10 are found by measuring the relative differences in voltage between the excited port and the loaded ports during simulation. The far-field gain pattern of FIG. 11 is measured as the gain in decibels of energy propagating from the antenna at the level of the horizon. It is calculated based on the electric field intensity of a vertically polarized electric-field wavefront propagating to a set of infinitely distant points on the horizon. The far-field phase pattern of FIG. 12 is calculated based on the difference in vertically polarized electric field phase between different angles at the horizon.

FIG. 10 shows the simulated plot of scattering parameters of the modeled antenna array. The bandwidth of the modeled antenna array is found to be 26% for a Voltage Standing Wave Ratio (VSWR) of 2.5:1. Peak inter-antenna element coupling is −14 dB for adjacent feed ports and −17 dB for diagonally opposite feed ports as shown in the plot of FIG. 10. Thus, a low coupling is achieved between the feed ports.

FIG. 11 shows a polar chart of a simulated azimuthal gain pattern of the modeled antenna array. The simulated gain pattern as shown in FIG. 11 has less than +/−1 dB of pattern ripple. Thus, a low azimuthal gain pattern ripple is achieved in the antenna array at the same plane as the antenna array, and as a result, a uniform azimuthal gain with minimal variation is achieved. FIG. 12 shows a rectangular chart of the simulated azimuthal phase pattern of the modeled antenna array. The chart shows azimuthal phase variation to exhibit +/−20° ripple or less at the horizon. Thus, FIG. 12 shows that a uniform phase is achieved.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The invention claimed is:

1. A cavity backed slot antenna array comprising:
an aperture comprising a dielectric layer and a metal layer disposed on the dielectric layer, the metal layer comprising:
a first annular region comprising a first slot region,
a second annular region comprising a second slot region, wherein the second annular region partially overlaps the first annular region, and
first and second radiating elements configured to radiate energy;
a first feed structure configured to excite the first radiating element and a second feed structure configured to excite the second radiating element, each of the first and second feed structures comprising a central portion and a plurality of fin structures arranged radially around the central portion; and
a backing cavity configured to support the aperture and the first and second feed structures.

2. The cavity backed slot antenna array of claim 1, wherein the first and second slot regions partially overlap each other.

3. The cavity backed slot antenna array of claim 1, wherein the aperture further comprises third and fourth annular regions arranged to partially overlap each other and the first and second annular regions;
wherein the third annular region comprises a third slot region;
wherein the fourth annular region comprises a fourth slot region; and
wherein the first, second, third, and fourth slot regions partially overlap with each other.

4. The cavity backed slot antenna array of claim 1, wherein a lateral distance between axes of symmetry of the first and second feed structures is equal to or less than half a wavelength at a center frequency of an operating frequency band of the cavity backed slot antenna array.

5. The cavity backed slot antenna array of claim 1, wherein a lateral distance between centers of the first and second slot regions is equal to or less than half a wavelength at a center frequency of an operating frequency band of the cavity backed slot antenna array.

6. The cavity backed slot antenna array of claim 1, wherein the first slot region comprises an outer radius and an inner radius; and
wherein a ratio of the outer radius to the inner radius ranges from about 1 to about 2.

7. The cavity backed slot antenna array of claim 1, wherein the first radiating element is electrically coupled to the first feed structure; and
wherein the second radiating element is electrically coupled to the second feed structure.

8. The cavity backed slot antenna array of claim 7, wherein the first radiating element comprises a first radial slot;
wherein the second radiating element comprises a second radial slot; and
wherein the first and second radial slots are configured to direct current flow in a direction parallel to the first and second radial slots and to prevent current flow in a direction perpendicular to the first and second radial slots.

9. The cavity backed slot antenna array of claim 1, wherein each fin structure of the plurality of fin structures comprises a tapered profile.

10. The cavity backed slot antenna array of claim 1, wherein each fin structure of the plurality of fin structures comprise a hemispherical or triangular profile.

11. The cavity backed slot antenna array of claim 1, wherein the first and second feed structures are positioned within the backing cavity such that there is a minimum lateral distance between walls of the backing cavity and the first and second feed structures; and wherein the minimum lateral distance ranges from about 0.1 wavelengths to about 0.5 wavelengths at a center frequency of an operating frequency band of the cavity backed slot antenna array.

12. The cavity backed slot antenna array of claim 1, wherein the plurality of fin structures are configured to prevent coupling between the first and second feed structures.

13. The cavity backed slot antenna array of claim 1, wherein a first gap is present between the first radiating element and the first feed structure and a second is present between the second radiating element and the second feed structure; and wherein the first and second gaps prevent a short between a ground plane and the first and second radiating elements.

14. The cavity backed slot antenna array of claim 1, wherein the first and second feed structures are radially symmetrical about the central portion.

15. A cavity backed slot antenna array comprising:

an aperture comprising a plurality of slot regions arranged to partially overlap each other and a plurality of radiating elements configured to radiate energy;

a plurality of feed structures configured to provide excitation to the plurality of radiating elements, each feed structure of the plurality of feed structures comprising a central portion and a plurality of fin structures arranged radially around the central portion; and a backing cavity configured to support the aperture and the plurality of feed structures.

16. The cavity backed slot antenna array of claim 1, wherein a lateral distance between centers of at least two slot regions from among the plurality of slot regions is equal to or less than half a wavelength at a center frequency of an operating frequency band of the cavity backed slot antenna array.

17. The cavity backed slot antenna array of claim 1, wherein at least one of the slot regions from among the plurality of slot regions comprises an outer radius and an inner radius; and wherein a ratio of the outer radius to the inner radius ranges from about 1 to about 2.

18. The cavity backed slot antenna array of claim 7, wherein each radiating element of the plurality of radiating elements comprises a radial slot; and wherein the radial slots are configured to direct current flow in a direction parallel to the radial slots and to prevent current flow in a direction perpendicular to the radial slots.

19. The cavity backed slot antenna array of claim 1, wherein each fin structure of the plurality of fin structures comprise a hemispherical or triangular profile.

20. A cavity backed slot antenna array comprising:

an aperture comprising:

a plurality of slot regions arranged to partially overlap each other and in a rectangular or a circular array configuration, and a plurality of radiating elements configured to radiate energy;

a plurality of feed structures configured to provide excitation to the plurality of radiating elements, each feed structure of the plurality of feed structures comprising a central portion and a plurality of fin structures, arranged radially around the central portion comprising a hemispherical or a triangular profile; and a backing cavity configured to support the aperture and the plurality of feed structures.

* * * * *